United States Patent [19]

Marks et al.

[11] 4,060,999

[45] Dec. 6, 1977

[54] METHOD AND APPARATUS FOR FORMING YARN ELEMENTS AND PRODUCING PRODUCTS THEREFROM

[75] Inventors: Ronald H. Marks; Paul D. Marks; Lawrence R. Goodman, all of Dallas, Tex.

[73] Assignee: Enterprise Incorporated, Dallas, Tex.

[21] Appl. No.: 521,037

[22] Filed: Nov. 5, 1974

[51] Int. Cl.[2] ..... D04B 3/06; D04B 15/48; D04B 27/10; D04B 35/00

[52] U.S. Cl. ..... 66/125 A; 66/202; 139/11; 28/166; 28/246

[58] Field of Search ..... 66/125, 202; 139/11; 28/71.3, 72 CS; 264/1 CS, 148, 149, 147, 284; 26/106

[56] References Cited

U.S. PATENT DOCUMENTS

| | | | |
|---|---|---|---|
| 2,169,886 | 8/1939 | Shaw | 139/11 X |
| 2,547,736 | 4/1951 | Blake | 26/106 X |
| 2,698,359 | 12/1954 | Roberts | 242/56.4 |
| 3,242,698 | 3/1966 | Marks et al. | 66/202 X |
| 3,282,071 | 11/1966 | Marks et al. | 66/202 X |
| 3,331,222 | 7/1967 | Marks | 66/202 |
| 3,336,645 | 8/1967 | Mirsky | 139/11 X |
| 3,394,429 | 7/1968 | Nakagawa et al. | 26/106 X |
| 3,444,683 | 5/1969 | Hessenbruch | 264/147 X |
| 3,446,041 | 3/1969 | Marks et al. | 66/125 |
| 3,461,199 | 8/1969 | Campbell | 26/106 X |
| 3,507,130 | 4/1970 | Marks et al. | 66/125 X |
| 3,568,279 | 3/1971 | Burnett et al. | 66/125 X |
| 3,608,025 | 9/1971 | Mirsky | 264/147 X |
| 3,645,299 | 2/1972 | Eichler et al. | 139/11 |

*Primary Examiner*—Ronald Feldbaum
*Attorney, Agent, or Firm*—Vinson & Elkins

[57] ABSTRACT

An improved apparatus capable of carrying out a continuous method of forming yarn elements from a supply roll of thermoplastic film, which method is characterized by slitting the roll into flat strips of preselected width, simultaneously subjecting the strips to heat and to a pulling or drawing force to elongate the strips which reduces their width and at the same time minimizes their subsequent stretch capability, and thereafter interengaging said strips on a textile-forming machine, such as a knitting or weaving apparatus, to form a desired product. The method is particularly adaptable to the production of an improved knitted bag formed of said flat yarn elements.

11 Claims, 8 Drawing Figures

METHOD AND APPARATUS FOR FORMING YARN ELEMENTS AND PRODUCING PRODUCTS THEREFROM

BACKGROUND OF THE INVENTION

There are various types of apparatus in use for carrying out a continuous method for forming yarn elements from a supply roll and directing the elements to a textile-forming machine. Examples of such prior apparatus and methods are illustrated in the U.S. patents to Marks U.S. Pat. No. 3,214,943 and Marks et al. U.S. Pat. No. 3,446,041. However, in the prior art, there has been no attempt to accurately control the elongation or stretching of the yarn elements for the purpose of reducing the width or size of each element, nor has there been any suggestion of minimizing the subsequent stretch capability of the element by controlling the elongation.

Where thermoplastic film is employed in prior art apparatus, the final product formed of the yarn elements is subject to undesirable deformation because each yarn element is stretchable. This characteristic is particularly noticeable if the product is a knitted bag forming a container because the contents of the bag usually cause stretching individual yarn elements.

Prior patents, such as the Marks U.S. Pat. No. 2,721,462, suggest the production of knitted bags which are laterally stretchable to encase food products to be smoked, such as ham, but such bags have been formed of twisted, as opposed to flat yarn elements. Such twisted elements cut into the product which they support and are difficult to remove without damaging the exterior of the product. Also, as is the case with U.S. Pat. No. 2,721,462, the yarn elements have been constructed of paper which is absorbent so that the elements absorb some of the juices from the product during the smoking operation.

SUMMARY OF THE INVENTION

The present invention involves the slitting of a web of thermoplastic material into strips of preselected widths followed by an accurate control of the elongation of said strips by the application of a preselected pulling or drawing force while subjecting said strips to controlled heat. Each yarn element so formed is of lesser width than each original strip so that the length of yarn elements per pound of material, as compared to such original strip, is increased. Also the elongation of the strips stretches each strip to a controlled point to reduce the subsequent stretch capability thereof and results in orientation of the thermoplastic material to increase its strength.

The invention also involves the production of a knitted bag formed of the relatively flat nonabsorbent yarn elements having minimum stretch characteristics and particularly adapted for encasing and supporting food, such as ham or turkey, during a smoking operation.

OBJECTS OF THE INVENTION

It is one object of this invention to provide an improved method and apparatus for forming yarn elements from a web of thermoplastic material, such as polypropolene film, by slitting the web into strips of predetermined size and thereafter stretching each strip under controlled conditions of heat and force application to produce a relatively flat yarn element capable of being directed into a textile machine, such as a knitting or weaving apparatus, to form a desired product.

Another object of the invention is to provide an improved method and apparatus for forming yarn elements wherein a controlled frictional retention of the movement of the web is effected, and also wherein the pulling or drawing force applied to the strips is accurately controlled to control the stretching or elongation of the strips to the desired degree.

Still another object is to provide a method and apparatus of the character described in which strips of thermoplastic material are passed through a heating zone for a predetermined time to soften the material and render it amenable to elongation, said strips being directed through the heating zone in a vertical parallel position, which spaces the strips a sufficient distance from each other to assure that adjacent strips will not be fused to each other during the heating period.

A further object is to provide an apparatus of the character described, having friction or holding rollers engaging the web of material prior to its being slit into strips and having pulling or drawing rollers which engage the strips after the web has been slit to enlongate said strips; the web presenting a relatively large area or surface for engagement by said friction rollers to assure desired braking action, thereby allowing the pulling rollers to elongate the strips in the desired manner.

A particular object is to provide an apparatus having braking rollers acting on the web and pulling rollers acting on the strips, with improved readily adjustable drive means associated with the rollers, whereby the speed of the braking rollers relative to the pulling rollers may be accurately controlled to thereby accurately control the amount of stretch or elongation which is imparted to the strips.

Another object is to provide as assembly which combines an improved yarn forming apparatus with a knitting machine, such as a circular knitting apparatus, whereby the yarn formed may be passed directly to the knitting machine to form a tubular knit structure; the knitting machine including a means associated with the rotating cylinder which will cause the tubular knit material to be formed into a relatively small spiral tube to facilitate the cutting of said tube to length and the closing of one end of such tube by suitable fastening means, as well as being easier to handle and store.

A further object is to provide an improved knitted bag product which is formed of a plurality of knitted flat strip elements of nonabsorbent material, whereby the bag is particularly adapted for smoking food products, such as ham or turkey, although it can contain and support other products in acting as a container.

Other objects and advantages of the present invention are hereinafter set forth and are explained in detail with reference to the drawings wherein.

DESCRIPTION OF THE PREFERRED EMBODIMENT

Figure 1:
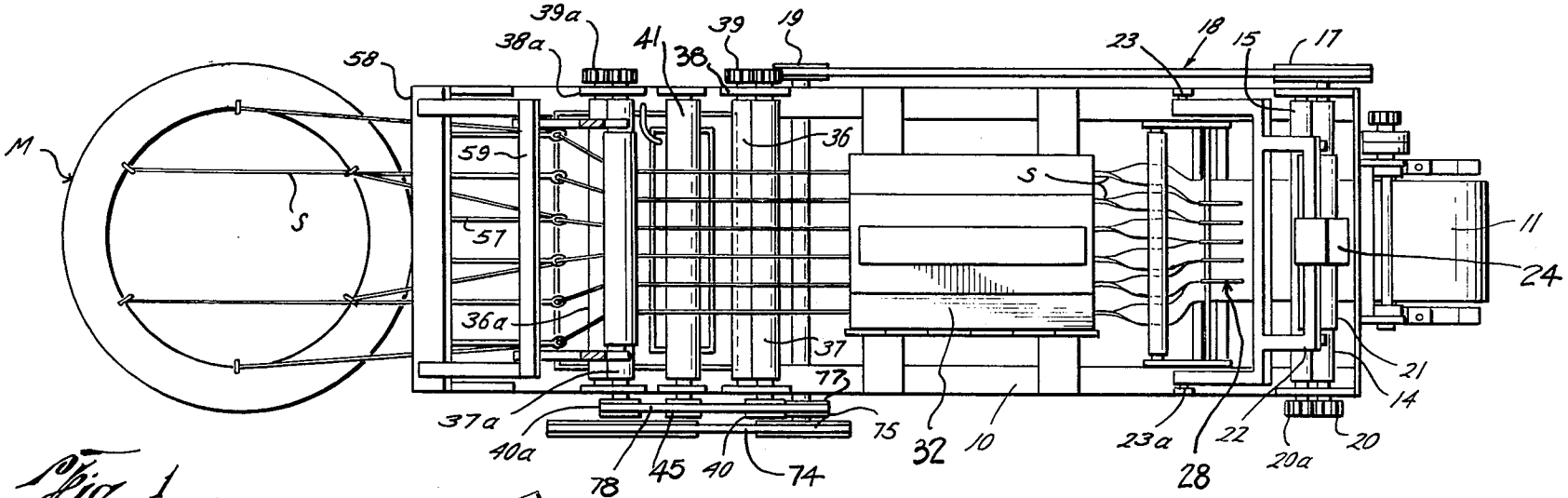
FIG. 1 is a plan view of the improved yarn forming apparatus, constructed in accordance with the invention, for carrying out the improved method.

In the drawings, the numeral 10 designates a generally rectangular supporting frame, preferably constructed of angle members supported by legs 10*a*, upon which the apparatus for forming the yarn elements is mounted. The yarn elements are formed from a web 11 (FIGS. 1–3) of material which is wound about a supply roll 12. The roll 12 is supported in bearings secured to legs 13 and is provided with the usual well-known brake (not shown) which places a drag upon the roll to prevent an uneven feeding off of the web 11 and which, if desired, can also be used to retard movement of the web to a desired degree.

The web 11 extends through an alignment guide G and then passes over a roller 14 and under a roller 15. The rollers extend transversely of the support frame 10 and have their ends rotatable within upright brackets 16 secured to and extending upwardly from frame 10. The rollers 14 and 15 function as drag or braking rollers and rotation is imparted to the rollers 14 by a driving gear 17 which is driven by a chain 18 and drive gear 19. The same rotation is imparted to the second roller 15 through interengaging 20 and 20*a* secured to that end of the rollers 14 and 15 which is opposite the gear 17.

Figure 2:
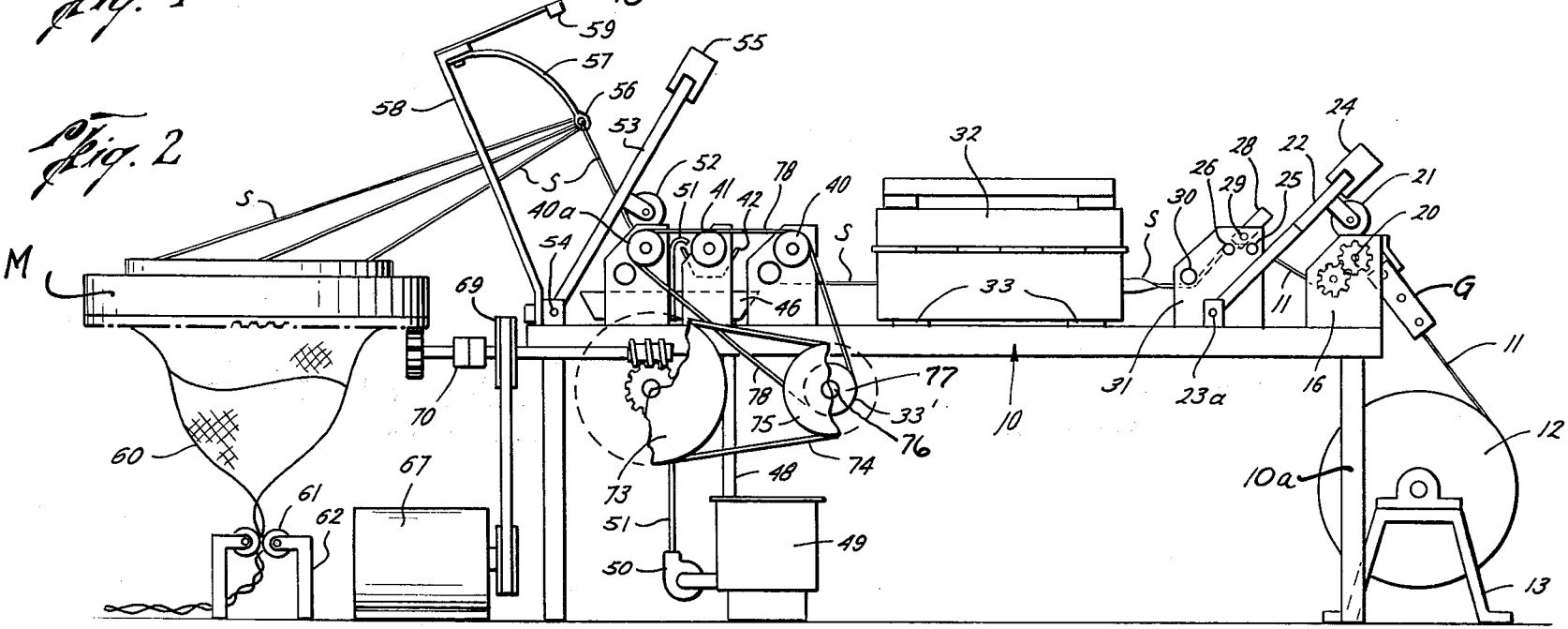
FIG. 2 is a side elevation of said apparatus and illustrating a standard circular knitting machine to which the yarn formed by the apparatus is directed.
Figure 4:
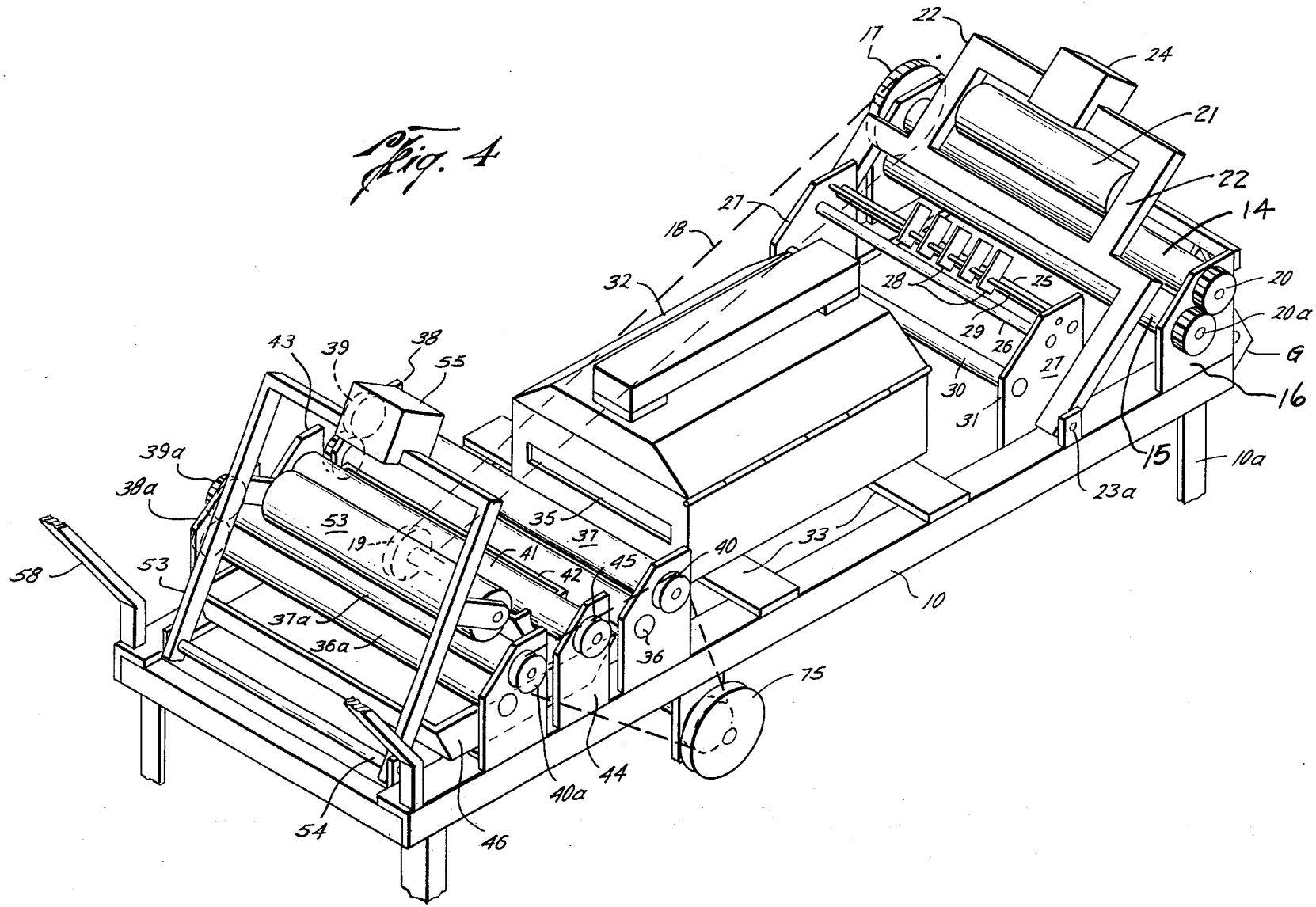
FIG. 4 is an isometric view of the yarn forming apparatus but omitting the material which passes through the apparatus to more clearly show the structure of the various parts.
Figure 5:
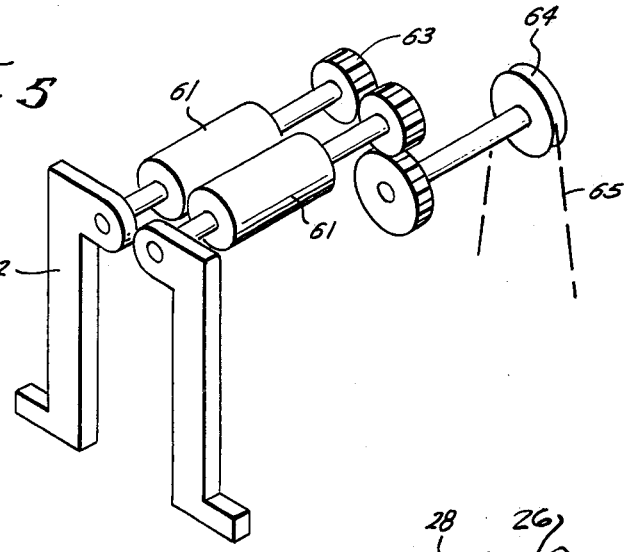
FIG. 5 is a partial isometric view of the holding rollers associated with the circular knitting machine to effect a spiraling of the tubular knit material as it leaves the knitting area.

For applying the desired friction in order to hold the web against free movement over the roller 14, a friction roller 21 overlies said roller and the web 11 passes between this friction roller and the roller 14. Roller 21 is carried by a frame 22 having its lower ends pivoted at 23 and 23*a* respectively to opposite sides of the main supporting frame 10. The upper end of the pivoted frame 22 extends beyond the friction roller 21 and a weight 24 is mounted thereon, being secured thereto by any suitable means. As shown in FIGS. 2 and 4, the carrying frame 22 is disposed at an angle so that weight 24 will apply a downward force to the friction roller 21. By changing this weight, the amount of frictional pressure applied to the web may be varied. It is also noted that since the frictional holding force is acting upon the web 11, an amplified surface is presented to the rollers 21 and 14 so that a good frictional contact between the web and rollers is assured.

After passing beneath the friction roller 21, the web is directed to a cutting area wherein idler rollers 25 and 26 are located. These rollers have their ends supported in upstanding brackets 26 which are welded or otherwise secured to the main support frame 10. Located centrally of and extending between the idler rollers 25 and 26 is a cutter assembly 28 which, as shown, consists of a plurality of razor blades carried by a transverse support bar 29, also supported by and extending between the uprights 27. The number of blades in the assembly 28 is dependent upon the number of strips into which the web 11 is to be divided and, of course, other types of slitter elements, such as slitter disks, could be employed.

The alignment guide G is located in longitudinal alignment with the cutter assembly and functions to guide the web evenly through the rollers 14, 15 and 21, so that when the web leaves such rollers, it is properly aligned with said cutter assembly. Thus, the accurate slitting of the web into the desired number of strips of preselected width is accomplished by the cutter assembly.

As the web moves over the idler rollers 25 and 26, it is contacted by the slitter assembly 28 and is cut into a plurality of strip elements S. Such strips S are then passed beneath a guide roller 30 which extends transversely across the main support frame 10 with its ends supported in upright angle brackets 31. The roller 30 guides the strips into a heater 32 which is of suitable length and which is preferably electrical with the well-known thermostatic control (not shown) to accurately control its internal temperature. As will be explained, the temperature of the heater is controlled, as is the travel time of the strips through the heating zone so that said strips, being of a thermoplastic material such as polypropolene, will be softened to the desired degree during their retention time within said heating zone. The heater is supported on suitable transverse supporting members 33 (FIG. 4) which extend across the top of the frame.

Figure 6:
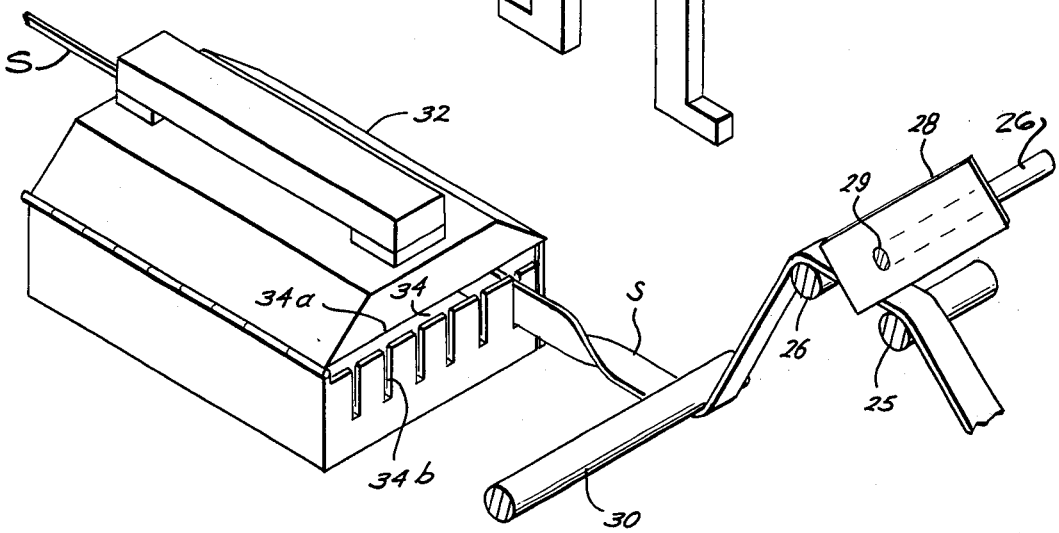
FIG. 6 is an isometric view of the heating chamber and illustrating the manner in which each strip or yarn element is introduced into said heating chamber.

Since the strips are formed of a thermoplastic material and are in relative adjacent positions as they pass beneath the guide roller, they may be subject to being fused together if they are passed through the heating zone in their normal flat adjacent positions. To prevent such fusing of the strips to each other, the strips are introduced into the heater 32 through an inlet opening 34, which is clearly shown in FIG. 6. The upper edge 34*a* of the inlet is substantially straight, while its lower edge is comb-like, being provided with a plurality of spaced slots 34*b*, each of which is of a width to receive one strip. Each strip S has its flat surface engaging the guide roller 30 and is then twisted so that it assumes what might be termed an upstanding vertical position as it enters the heater. The plurality of strips are each in one of the slots 34*b* and are thus sufficiently spaced from each other as they pass through the heating zone that there is no danger of one strip being fused to the adjacent one.

Figure 3:
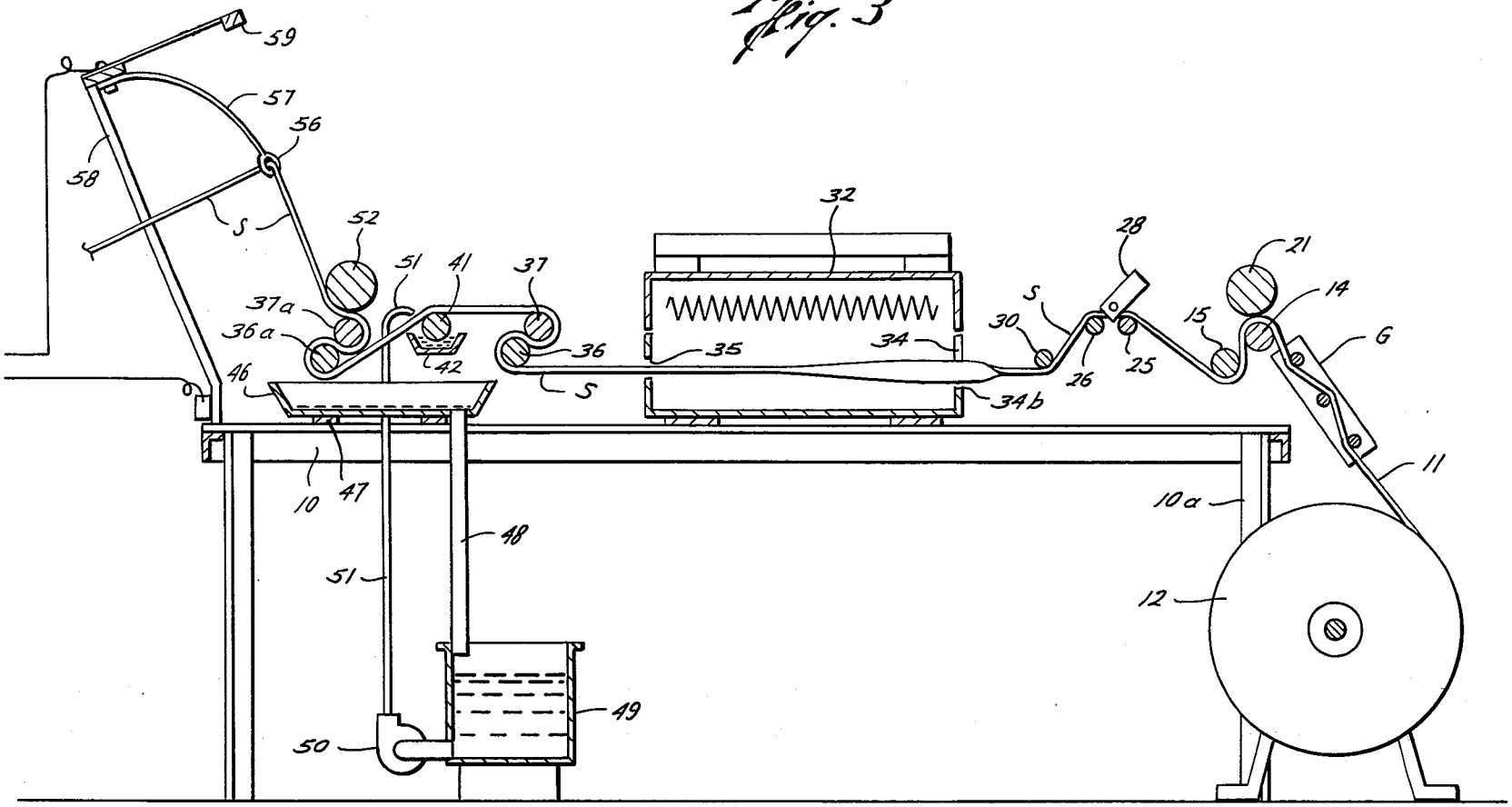
FIG. 3 is a general diagrammatic view partially in section and illustrating the manner in which the material passes through the apparatus to form the yarn.

The opposite end of the heater is formed with an outlet opening 35 (FIG. 4) and the strips exiting through this opening are, as will be explained, narrower in width than the width of the strips entering the heater. These narrower strips are then directed beneath a pair of pulling or drawing rollers 36 and 37, each strip passing beneath roller 36 and around and above roller 37 (FIG. 3). The pulling rollers 36 and 37 are supported in upright bracket members 38 and are interconnected to rotate together by gears 39. The roller 37 has a drive pulley 40 secured to that end opposite the gears 39 and when this pulley is driven, rollers 36 and 37 are rotated together to apply a pulling force to the strips which are engaged thereabout.

A second set of pulling rollers 36*b* and 37*a* are spaced from the rollers 36 and 37 and are supported in suitable upright brackets 38*a*. Interengaging gears 39*a* cause these pulling rollers to rotate together and the upper roller 37*a* has a drive pulley 40*a* mounted at that end opposite the gears 39*a*. As shown in FIG. 3, the strips S pass around the lower roller 36*a* and over the upper surface of roller 37*a*.

As will appear from a subsequent description of the overall drive means, the pulling rollers 36, 37 and 36*a*, 37*a* are rotated at the same speeds.

Located between the pair of rollers 36 and 37 and the pair of rollers 36*a* and 37*a* is a lubricating roller 41 which rotates within a lubricant container 42. The particular liquid within the container 42 is one which renders the thermoplastic material more amenable to a knitting operation. The roller 41 has its ends mounted in bearings 43 secured to upright supports 44 having their lower ends attached to the frame 10. One end of the roller 41 is provided with a drive pulley 45 so that said roller may be rotated to apply lubricant to the strips passing over the upper end of said roller. Beneath the container 42 is a drip pan 46 suitably supported on the main frame 10 by transverse bars 47. Any liquid which is within the drip pan 46 gravitates through a pipe 48 to a liquid supply 49. This supply is connected to the inlet of a pump 50, the outlet of which connects with a return pipe 51 having its upper end overlying the container 42. With this arrangement, there is a recirculation of any liquid which reaches pan 46, since this liquid is returned by the pump into container 42.

To remove excess liquid from the strips passing over the roller 37*a*, a squeeze roller 52 is adapted to overlie the roller 37*a*. As is clearly shown in FIGS. 2 and 4, the squeeze roller 52 is carried by a frame 53 having its lower end pivoted in bearings 54 mounted on the main support frame 10. The frame 53 extends at an angle and a suitable weight 55 may be secured to its upper end. By varying the weight 55, the pressure of the squeeze roller 52 upon the strips S passing over the drive roller 37*a* may be varied, whereby the excess amount of liquid lubricant is squeezed from the strips and drips downwardly into the drip pan 46, after which it is recirculated to container 42.

After passing between rollers 37*a* and the squeeze roller 52, each strip is directed through the eye 56 of a flexible or spring arm 57. The upper ends of all of the arms are secured to a support 58 which extends upwardly from the main supporting frame. The purpose of the flexible arms is to provide a means to indicate when one of the strips has become broken. When one of the strips S is broken, its flexible arm 57 will move upwardly into engagement with a contact bar 59 and this will close an electrical circuit to a cutoff switch (not shown) which will shut down the power which is operating the apparatus. It is not deemed necessary to describe the switch means and the spring arms in detail since this arrangement is disclosed in the prior patent to Marks et al U.S. Pat. No. 3,446,041.

After passing through the flexible arms 57, the strips or yarn elements are conducted to any textile-forming machine. However, as shown in FIG. 2, the strips are directed to a standard circular knitting machine M wherein the strips are knitted into a circular knitted tube 60. For a product bag, it has been found that a tube of 16 inches in diameter is satisfactory in forming a proper size bag. In order to facilitate this tube being cut to length and having one of its ends closed, it is desirable to spiral the material into a smaller tubular form.

To accomplish the spiraling of the knitted tubular fabric 60 coming from the circular knitting machine, a pair of holding rollers 61 is carried by suitable brackets 62. The brackets maintain the rollers in a stationary or fixed position with respect to the knitting machine and since the tubular knit fabric is rotating with the rotating cylinder of the knitting machine, it is evident that the stationary rollers which undergo no rotation on the axis of the knitting machine, will cause the material to be spiraled into a relatively small diameter tube as indicated at 60*a* in FIG. 2. To facilitate the passage of the material through the rollers 61, it is preferable that said rollers be rotated, and this is accomplished through interengaging gears 63 driven by a pulley 64 through a suitable drive belt 65.

Figure 7:
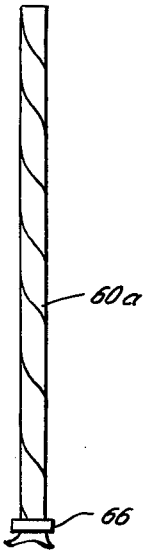
FIG. 7 is a side elevation of the spiraled tubular knit material showing it cut to predetermined size and having one end closed.
Figure 8:
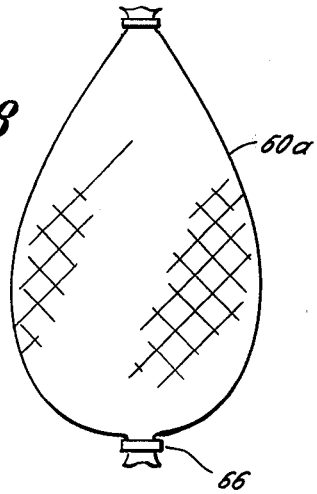
FIG. 8 is a view of the knitted bag of FIG. 7 showing a product contained therein.

The relatively small tube 60*a* which is formed in the manner described is then cut to length as shown in FIG. 7, and one end thereof is closed by a clamp 66 or other means. When so closed, the knitted tubular material forms a bag which is open at one end and when a meat product, such as a ham, is placed therein, the knitted material will enlarge around such product and its upper end may then be tied closed as shown in FIG. 8. The knitted material will spread sufficiently to receive the product and provides very large openings to facilitate the smoking of said product, allowing the smoke to contact the surface of the product. The yarn elements formed by the strips S remain relatively flat although they are of smaller width than the original width to which they were slit. These flat strips will engage the surface of the product and provide sufficient support without cutting into said surface. Being constructed of a thermoplastic material, the yarn elements are also non-absorbent and will not absorb the juices of any meat product which may be subjected to a smoking operation while contained within the bag. Additionally, the stretching of the material as it passes through the apparatus reduces the capability of further stretching and also results in some orientation of the plastic material so that the yarn elements are considerably stronger than the strips prior to their passage through the heating and the stretching zones.

Although the apparatus may be driven in any suitable manner, it is desirable that it be driven from the same power source which drives and operates the circular knitting machine M. As illustrated in FIG. 2, an electric motor 67 drives the knitting machine M through a belt or chain 68 and a pulley or gear 69. A suitable clutch 70 is disposed between the drive pulley or gear and the knitting machine. A worm screw 71 is mounted on the shaft of the drive gear or pulley 69 and rotates a gear 72 on the shaft of which is mounted a relatively large drive pulley 73. A belt 74 passes around the drive pulley 73 and also about a main drive pulley 75 for the yarn forming apparatus. The pulley 75 is mounted upon a shaft 76 which is supported and extends transversely below the main frame 10; this shaft has the gear 19 mounted on its opposite end so that when the pulley 75 and its shaft is rotated, said gear is rotated to drive the gear 17 of the retarding rollers 14 and 15 through the chain 18.

Also mounted on the shaft 76 and located inwardly of the main drive pulley 75 for the yarn forming apparatus (FIG. 1) is a pulley 77. A belt 78 passing around this pulley also passes about pulleys 40, 45 and 40*a* to rotate the rollers 36 and 37, the rollers 36*a* and 37*a* and the lubricating roller 41. Thus, the entire apparatus is driven from the single motor 67 and by arranging the pulleys in proper size relationship to each other, the speed of travel of the springs through the apparatus may be accurately controlled.

As is well known, the knitting machine may be provided with a variable speed drive so that the speed of rotation of the knitting machine may be varied. Variable speed adjustment may also be included in connection with the main drive pulley 75 for the yarn forming apparatus so that the speed of travel of the strips through the yarn forming apparatus may be changed to suit different conditions. Because variable speed drives are well known, it is not deemed necessary to detail the same, it being sufficient to state that the variable speed for the knitting machine would be located between the motor 67 and pulley or gear 69 on the shaft extending to the knitting machine and the variable speed drive for controlling the yarn forming apparatus would be disposed at some point between the pulley 73 and the pulley 77. Any well known type of variable speed mechanism may be employed.

The operation of the yarn forming apparatus is best seen in the diagrammatic cross-sectional view of FIG. 3 and in the plan view of FIG. 1. The web of material 11 leaves the supply roll and passes through the guide G so that the sides of said guide prevent any transverse misalignment of the web as it moves between the roller 14 and the friction roller 21. As has been noted, the guide G is in longitudinal alignment with the slitter assembly 28 whereby the web 11 is fed into the slitter over the idler rollers 25 and 26 in a proper aligned position to form the strips S of preselected widths.

Following the slitting operation, the strips S pass beneath the guide roller 30 and are then introduced into the inlet end 34 of the heater 32. By reason of the slots **34*b* of said inlet opening, each strip is twisted so that its edges are in vertical plane as it enters the heating zone within the heater 32. The disposition of the slots 34*b* space the strips a sufficient distance from each other as they move into the heating zone whereby contact between adjacent strips is prevented to obviate fusing of the strips to each other during passage through the zone. The strips S exit from the heating zone through the outlet opening 35 and are threaded about the two sets of pulling rollers 36 and 37 and 36*a* and 37*a***. After passing over the pulling rollers, the strips S are directed to the textile machine which adds its pulling force to said rollers to pull or draw the strips into the textile machine.

The actual stretching of the strips is accomplished within the heating zone formed by the heater 32. The temperature within this zone is preselected and the retention time of the strip within the zone is controlled by the speed of movement of the strips therethrough to effect a softening of the strip material which renders said material more amenable to softening. The speed is controlled by the rotation of the pulling rollers 36, 37 and **36*a*, 37*a* in relationship to the speed of rotation of the holding or friction rollers 14, 15 and 21. The pulling rollers are rotated by the main drive pulley 75 which also rotates the shaft 76 upon which the gear 19 is mounted. The driving relationship between the gear 19 and the gear 17 of the holding rollers 14, 15 and 21 is the main controlling factor as to the amount of pulling or drawing force which is applied to the strips within the heating zone. As has been explained, the main drive pulley 75 also drives the pulleys 40 and 40*a* of the pulling rollers 36, 37 and 36*a*, 37*a*. The speed of rotation of said pulling rollers is known and by setting up the proper relationship between gears 19 and 17**, a preselected holding or braking force may be applied to the web material to thereby control the pulling force.

The friction roller 21 and holding rollers 14 and 15 are acting upon the web 11 which provides a relatively amplified surface, as compared to the strip elements, for contact with said rollers. By rotating the holding rollers 14 and 15 at a lower speed than that of the pulling rollers 36, 37 and **36*a*, 37*a***, the strips are held back against the pulling force which is being applied to the strips within the heating zone. Although this force is variable as desired, it has been found that a sufficient pulling or drawing force is satisfactory where the strip material is stretch in the ratio of about 5 to 1. Such stretching is not sufficient to break the material but results in a reduction in the width of each strip. This means that the material has very minor stretch capabilities remaining therein and when each strip is interengaged with other strips as in a knitting or weaving operation, it will not undergo any appreciable further extension or elongation. The stretching in order to reduce the width of each strip also results in an orientation of the film which, as is well known, increases the strength of the strip. By stretching the material in the manner described, the advantages of eliminating subsequent undesirable stretch in a finished product and the increase in strength are also supplemented by the additional advantage of obtaining longer lengths of strips from a predetermined amount of supply material than would be the case if the web was merely slitted and then taken to the textile machine, as has been the prior practice.

As has been noted, various thermoplastic films, such as polypropolene, polyethylene compounds, vinyl and other plastic film material, may be employed in the present method to produce the yarn elements. Polypropolene has been found particularly applicable to the present method because it is relatively economical. In actual practice, polypropolene film of 0.003 inch thickness is capable of being stretched on a 5 to 1 ratio to reduce its width. Such polypropolene film has the characteristic of becoming soft, which renders it more amenable to stretching, at about 250° to 300°, and the amount of heat in the heater 22 is related to the travel time. To perform a resonably fast knitting operation, the strips are fed into the heater at about 20 feet per minute but by reason of the stretching, are being pulled from the heater at about 100 feet per minute. Under these conditions and this reaction time within the heater, it has been found desirable to maintain the heater temperature at about 350°, which assures that there is sufficient softening of the film to facilitate the stretching.

As has been noted, such stretching substantially eliminates any subsequent stretch capability in the yarn elements, particularly after the elements have cooled. Even if heated, there is a minimum stretch in each of the elements after they are incorporated in the knitted structure. Actual tests have shown that subsequent heating of the knitted bag during a smoking operation results in a very minor further stretching of the elements in the order of about 1 inch per every 3 feet; in a bag structure, this can be tolerated.

The necessary lubrication which facilitates the strips passing through the textile machine, such as the circular knitting machine shown in FIG. 2, is added by the lubricating roller 41 which rotates within the lubricant contained within a suitable container 42. Upon leaving the drive rollers **36*a* and 37*a*, the squeeze roller 52 removes excess liquid from the film strips and said strips are then directed to a textile machine. When the textile machine is a circular knitting machine such as shown in FIG. 2, a tubular material 60 is formed on the circular knit machine by the rotating cylinder and the usual knitting needles. Where the tubular product 60 is to be employed as a bag for smoking products or for containing food products generally, it is desirable to reduce the size of the tube which is coming off of the knitting machine M and for this purpose, the stationary rollers 61 are mounted to receive the material and hold it against rotation so that as the knitting cylinder turns, the tube 60 is converted into a generally small spiral form as shown at 60***a* in FIG. 2.

The material 60*a* is then cut to length as indicated in FIG. 7, and a suitable clip or fastener 66 closes one end thereof. As has been described, the tubular piece 60*a* can be greatly enlarged by reason of its knitted structure to contain a ham, turkey or other food product to be subjected to a smoking operation. The bag as it contains the food product is illustrated in FIG. 8.

Although the apparatus has been shown and described as forming a tubular knit product which may be subsequently employed as a bag for containing any type of product, the apparatus can be used to feed its strips or yarn elements to any type of a textile machine. If fed to a large knitting machine, it would form a relatively large circular woven product which could be slit to form flat material. On the other hand, if it is fed to a loom or weaving machine of some type, the strips could be woven into any desired final product.

In the present disclosure, the apparatus has been shown as forming six yarn elements being fed to a 12-inch circular knitting machine, but it is pointed out that any desired number of strips may be simultaneously formed. The number will, of course, depend upon the size of the knitting machine and the number of yarn elements to be fed thereto. The illustration of only six yarn elements was chosen merely for the purpose of clarity, since to increase the number would have obscured various operating parts of the invention and complicated the drawings.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. An apparatus for forming yarn elements including, a supply roll of thermoplastic web material which is a relatively thin film and which is easily distorted when unequal pulling forces are applied to the web in a direction longitudinally of the web, a set of rotatable holding rollers engageable with the web material, at least one of said holding rollers being located beneath the web material and another of said holding rollers being located above the web material with both of the rollers extending completely across the web material and applying equal holding force to said web material throughout its entire transverse width, a set of rotatable pulling rollers, a cutter assembly between the holding rollers and the pulling rollers, means for conducting the web material to said holding rollers, means for directing said web material through the cutter assembly to cut the web into strips, a heater forming a heating zone located between the cutter assembly and the pulling rollers, whereby the strips pass through said heater to soften the same, means forming part of the heater for preventing the edges of the strips from fusing to each other as they pass through the heating zone, and means for operating the holding rollers at a slower rotative speed than the pulling rollers, whereby said pulling rollers pull the web material through the cutter assembly and heater and simultaneously exert a pulling force upon the softened strips to elongate the strips and reduce their width.

2. An apparatus for forming yarn elements as set forth in claim 1 together with means for controlling the relative rotative speeds of the holding rollers and the pulling rollers to control the amount of pulling force and to control the rate of movement of the strips through the heating zone.

3. An apparatus for forming yarn elements as set forth in claim 1 wherein, the heater is provided with an inlet opening having spaced vertical slots for receiving the strips passing therethrough and for spacing said strips from each other, said spaced vertical slots functioning as the means for preventing fusing the strips to each other during their passage through the heating zone of the heater.

4. An apparatus for forming yarn elements as set forth in claim 1 wherein the set of rotatable holding rollers comprises a pair of rollers about which the web material passes and an enlarged friction roller which engages said web material and confines it against one of the other rollers, and means for mounting said friction roller so that a predetermined force may be applied thereto to thereby control the force with which said friction roller engages the web material.

5. An apparatus as set forth in claim 1 wherein the means for conducting the web material to the holding rollers comprises a guide member which is located in longitudinal alignment with the cutter assembly to assure that the web material will be maintained in proper alignment with said cutter assembly at all times.

6. An apparatus for forming yarn elements as set forth in claim 1 together with, means for applying a liquid lubricant to the strips as the same move through the rotatable pulling rollers, and means for removing the excess liquid lubricant from said strips as the strips exit from the apparatus.

7. An apparatus for forming yarn elements as set forth in claim 2 wherein the means for conducting the web material to said holding rollers includes an elongate guide means through which the web material is passed to prevent lateral movement of the material, said guide means being in longitudinal alignment with the cutter assembly to assure that the web material is directed to the cutter assembly in aligned position.

8. An apparatus for forming yarn elements according to claim 1 including, a circular knitting machine, means for directing the elongated strips to the circular knitting machine to knit a tubular structure, and a non-rotative assembly, including roller members, through which the tubular knit structure is passed, whereby the rotation of the cylinder of the knitting machine in combination with the holding action of said assembly results in forming the tubular knit structure into a relatively small spiral of material.

9. An apparatus according to claim 8 wherein a single power means operates the circular knitting machine and said strip directing means.

10. An apparatus for forming yarn elements including, a supply roll of thermoplastic web material, a set of rotatable holding rollers, a set of rotatable pulling rollers, a cutter assembly between the holding rollers and the pulling rollers, means for conducting the web material to the cutter assembly to cut the web into flat strips which have their flat surfaces in a horizontal plane, a heater forming a heating zone located between the cutter assembly and the pulling cutters, said heater including an elongate casing having an inlet end wall and an outlet end wall at opposite ends thereof, the outlet end having a horizontal opening through which the strips pass in leaving the heater, the inlet end wall having a plurality of vertically disposed slots through which the strips are directed as they enter the heater, said inlet end wall forming the inlet side of the heater casing and being located a sufficient distance from the slitter that the strips may undergo a twisting movement to position the strips with their flat surfaces in a vertical position upon entry through the vertical slots of said end wall, whereby the strips pass through the heater in spaced relationship to prevent fusing the strips to each other during passage through the heater, and means for operating the holding rollers at a slower rotative speed than the pulling rollers, whereby said pulling rollers exert a pulling force upon the softened spaced strips within said heating zone to elongate the strips and reduce their width.

11. An apparatus for forming yarn elements as set forth in claim 10 together with means for controlling the relative rotative speeds of the holding rollers and the pulling rollers to control the amount of pulling force and to control the rate of movement of the strips through the heating zone.

* * * * *